US006506227B1

(12) United States Patent
Tornberg

(10) Patent No.: US 6,506,227 B1
(45) Date of Patent: Jan. 14, 2003

(54) PROCESS FOR THE POWDER METALLURGICAL PRODUCTION OF OBJECTS

(75) Inventor: Claes Tornberg, Kapfenberg (AT)

(73) Assignee: Bohler Edelstahl GmbH, Kapfenberg (AT)

( * ) Notice: Subject to any disclaimer, the term of this patent is extended or adjusted under 35 U.S.C. 154(b) by 0 days.

(21) Appl. No.: 09/874,282

(22) Filed: Jun. 6, 2001

(30) Foreign Application Priority Data

Apr. 11, 2001 (AT) ..... 585/01

(51) Int. Cl.[7] ..... C22C 33/02
(52) U.S. Cl. ..... 75/246; 419/30; 419/49
(58) Field of Search ..... 419/49, 30; 75/246

(56) References Cited

U.S. PATENT DOCUMENTS 4,565,668 A * 1/1986 Aslund et al. ..... 419/68
5,976,459 A * 11/1999 Eisen et al. ..... 419/49
5,989,490 A * 11/1999 Pinnow et al. ..... 419/11
6,099,796 A * 8/2000 Eisen et al. ..... 419/54
6,162,275 A * 12/2000 Jonsson et al. ..... 75/238

* cited by examiner

*Primary Examiner*—Daniel J. Jenkins
(74) *Attorney, Agent, or Firm*—Greenblum & Bernstein, P.L.C.

(57) ABSTRACT

The invention relates to a process for the powder metallurgical production of objects from tool steel as well as to such an object. The quality of the material, in particular its homogeneity, its degree of purity, and the properties of the same is/are increased by using the process according to:the invention, in which a melt is placed in a metallurgical vessel and conditioned therein, whereupon a powder with an average grain diameter of 50 to 70 $\mu$m is produced from this melt by atomizing it with nitrogen at a temperature that is essentially kept constant, this powder is disintegrated in the nitrogen stream and, while maintaining the nitrogen atmosphere, the powder with a maximum grain diameter of 500 $\mu$m is classified, collected, mixed, introduced into a capsule with a diameter or thickness greater than 300 mm and a length greater than 1000 mm, compacted in this container, and the container is sealed in a gas-tight manner, whereupon, in a hot isostatic pressing cycle therefor, the parameters are set such that, in the heating process, the temperature and the pressure are increased and an isostatic pressing process then is carried out and subsequently the HIP pressed blank is cooled and this pressed blank is optionally then hot formed and, in this manner, a highly pure material with a K0 value according to DIN 50 602 of essentially no greater than 3 is produced.

26 Claims, 2 Drawing Sheets

PROCESS FOR THE POWDER METALLURGICAL PRODUCTION OF OBJECTS

BACKGROUND OF THE INVENTION

The invention relates to a process for the powder metallurgical production of objects from tool steel with improved homogeneity, greater purity, and improved properties.

The invention further relates to a tool steel object with an improved property profile.

Tool steels with a high concentration of carbon and high contents of carbide-forming elements are used for cutting parts and components with a high degree of wear resistance. Because inhomogeneities as well as coarse primary and eutectic carbides are formed during solidification of such alloys in casting molds, which cause production problems and poor mechanical characteristics of the tools or components produced therefrom, a powder metallurgical production of such parts is advantageous.

A powder metallurgical production essentially includes atomizing of a tool steel melt into metal powder, collection and compaction of the metal powder in a container or capsule, respectively, sealing the capsule, and heating and hot isostatic pressing of the powder in the capsule into a dense, homogeneous material.

When the melt is being atomized which, according to the prior art, advantageously is done using nitrogen, small metal droplets with a high ratio of surface to volume are formed in the gas stream, which causes a high cooling and solidification speed of the liquid metal and, therefore, small carbide particles in the powder grains. As mentioned previously, the powder, which is usually compacted in the capsule by means of tapping, is formed in the capsule by means of hot isostatic pressing at temperatures usually greater than 1080° C. at a pressure greater than 85 MPa into a completely dense metal body. This AS HIPed metal body, which may be subjected to another hot forming process, at a high carbon content has an advantageously low carbide size of an average of 1–3 um and good mechanical properties as compared to production using melt metallurgy.

While objects produced from tool steel using powder metallurgy do have an advantageous structure with finely distributed carbide phases, the high quality potential of PM materials that can be achieved cannot be realized due to an incomplete material isotropy and a poor degree of purity.

SUMMARY OF THE INVENTION

Here, the invention is intended to provide a remedy and has the object of eliminating the lack of quality of the objects produced from PM tool steel according to the prior art and providing a process of the type mentioned at the outset with which an isostatically pressed metal body that has maximal material isotropy and a minimal content of oxide inclusions may be produced.

A further goal of the invention is a tool steel object with improved processing and use properties at an increased useful service life.

This goal is attained in a process of the above type in that a melt is placed into a metallurgical vessel and is conditioned therein, this is an improvement in the degree of oxide purity of the same and an adjustment of the temperature to a value above the formation of primary precipitations in the alloy, whereupon, with the temperature being kept essentially constant, a powder that has an average grain diameter of 50 to 70 $\mu$m is produced from this melt by means of atomizing with nitrogen, is disintegrated in the nitrogen stream, and, while maintaining the nitrogen atmosphere, the powder with a maximum grain diameter of 500 $\mu$m is classified, collected, mixed, and placed into a container with a diameter or thickness greater than 300 mm and a length greater than 1000 mm, compacted in this container or capsule by means of mechanical strokes, and the container is sealed in a gas-tight manner, whereupon, in a hot isostatic pressing cycle therefor, the parameters are set in such a way that the temperature and pressure are increased in the heating process, wherein a pressure of 1 to 40 MPa from all sides is exerted in the powder body of the container or capsule, respectively, and subsequently an isostatic pressing operation occurs at a temperature of at least 1100° C., but a maximum of 1180° C., at an isostatic pressure of at least 90 MPa for a period of time of at least three hours and the HIP pressed body is then cooled and, optionally, this pressed body is subsequently hot formed and, in this manner, a material with a K0 value according to DIN 50 602 of essentially a maximum of 3 is produced.

The advantages achieved with the process according to the invention are essentially based on the fact that, synergetically by means of metallurgical working of a melt placed in a metallurgical vessel, initially the degree of oxidic purity of the melt is decisively improved and its temperature is homogeneously adjusted to an advantageous overheating value, whereupon an atomization of the liquid metal is carried out in such a way that the average grain diameter is 50 to 70 $\mu$m. In this manner, it is achieved that, on the one hand, the oxygen content in the powder is surprisingly low and, on the other hand, the fine-grained portion is also significantly increased with respect to achieving a high tapping and vibration density in the capsule. If, as provided according to the invention, the metal powder is classified, collected, placed in a container, compressed in this container, and the container is sealed, all while maintaining the nitrogen atmosphere, no oxidation or physisorption of oxygen on the powder grain surface can occur.

A distribution according to the invention of the grain diameter with an average value in the range of 50 to 70 $\mu$m allows an unexpectedly high powder density to be attained in the capsule such that, on the one hand, the degree of shrinkage thereof in hot isostatic pressing is low and, on the other hand, a substantially complete isotropy of the pressed dense metal body is present. These advantages are also achieved with container or capsule sizes with a diameter or a thickness greater than 300 mm and a length greater than 1000 mm.

The parameters for the hot isostatic pressing cycle include a heating of the powder in the capsule at a substantially simultaneous increase of temperature and pressure, whereby, as has been shown, an increase in the material density and homogeneity is achieved, already in this phase. The subsequent pressing operation is carried out in the temperature range of 1100° C. to 1180° C. at a pressure of 90 MPa and more with a duration of at least three hours, followed by a slow cooling of the pressed body. Lower pressing temperatures than 1100° C. and pressures less than 90 MPa as well as lower pressing times than three hours can cause porosity in the material.

After HIPing, the pressed body has a completely dense material structure and can therefore by processed into a tool in this state or after another hot forming operation.

For the high quality of the tool steel object produced with powder metallurgy using the process according to the invention, its lower amount of inclusions as well as its low inclusion size are characteristic. The high oxidic degree of purity that is documented by a K0 value according to DIN 50 602 of essentially not higher than 3 not only leads to markedly improved mechanical characteristics of the material in all stress directions, in particular at high application temperatures, but also improves its use properties, preferably the edge-holding property of fine cutting tools, to a large degree.

Figure 1B:
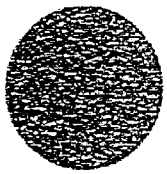
FIG. 1 shows powder in a bulk fill according to the present invention.

A particularly marked increase in quality of the object is achieved in production according to the process of the invention if the melt is formed of an iron-based alloy containing in wt-%:

| | | | |
|---|---|---|---|
| Carbon (C) | 0.52 | to | 3.74 |
| Manganese (Mn) | | up to | 2.9 |
| Chromium (Cr) | | up to | 21.0 |
| Molybdenum (Mo) | | up to | 10.0 |
| Nickel (Ni) optionally | | up to | 1.0 |
| Cobalt (Co) | | up to | 20.8 |
| Vanadium (V) | | up to | 14.9 |
| Niobium (Nb) and tantalum (Ta) individually or in sum | | up to | 2.0 |
| Tungsten (W) | | up to | 20.0 |
| Sulfur (S) | | up to | 0.5 |

as well as accompanying elements up to a total concentration of 4.8 and impurities and iron as the balance.

The above chemical composition of the tool steel includes especially carbide-rich tool steels with a high wear resistance and a high edge-holding property of the tools produced therefrom. Because generally high carbide contents worsen the mechanical properties of the material, their fundamental improvement by means of the process according to the invention is of particular significance. It has been shown that these high mechanical characteristic values, especially those of the impact bending strength of the material, are synergetically caused by the small average grain diameter of the powder, a homogenous, dense packing of the same in the capsule, and by the high oxidic degree of purity in the isotropic structure of the hot isostatically pressed object.

The oxidic degree of purity of the liquid metal can be effectively improved by means of metallurgical working when a conditioning of the melt in the metallurgical vessel with an induced turbulent flow of the same and during a complete covering of the metal bath by liquid slag, which is heated in particular by means of electric current directly passing through, occurs during a time period of at least 15 minutes. Here, a release of oxygen compounds and/or oxides from the melt and a taking up of the same in the hot slag is promoted, with the induced flow of the metal bath increasing the efficiency. It is known per se to achieve a flow of liquid metal in a metallurgical vessel by means of introducing argon stirring gas through at least one gas-permeable porous brick positioned at the bottom. However, in order to prevent a reoxidation of the melt, it is important for the covering by liquid slag to be completely maintained, even while the melt is in motion. In order to prevent problems in using a porous brick as regards the reliability of the formation of a controlled and efficient metal flow as well as in order to prevent difficulties in the feeding of the pumping and/or stirring gas, with small amounts of gas showing little metallurgical effect but large amounts of gas leaving parts of the surface of the melt without slag and oxidizing them as well as possibly mixing slag particles into the steel, it is preferred to use electromagnetic means, for example, electromagnetic stirring coils, for inducing a turbulent flow in the liquid metal. Here, also setting and evenly distributing the temperature of the metal bath by means of incorporating heat energy into the slag using electric current flow can be most advantageous.

In another embodiment of the invention, it is provided for the conditioned melt to be introduced into an atomizing chamber by means of a nozzle body in the metallurgical vessel with a melt stream diameter of 4.0 to 10.0 mm and, in this chamber, to be impacted by three subsequent gas streams composed of nitrogen with a degree of purity of at least 99.999%, provided that the last impacting of the melt stream occurs by means of a gas stream that has at least in some places a speed that is greater than the speed of sound. Maintaining the diameter of the melt stream constant and the high kinetic energy of the gas impacting the metal stream cause a favorable grain distribution and a desired fineness of the metal powder produced. Moreover, the conditioning and the adjustment of the temperature of the liquid metal in the metallurgical vessel as well as the high degree of purity of the atomizing gas nitrogen are the causes of a surprisingly high degree of purity and a low oxygen content of the powder and, as a result, of the hot isostatically pressed block.

Because even small amounts of coarse grains in metal powder can lead to separation, especially when filling the capsule and when compacting the powder therein, it is advantageous when the diameter of the powder grains is being adjusted by using atomizing technology or classified to a maximum value of 500 $\mu$m using spray technology.

In any case, in order to ensure a homogeneous dumping and in order to increase the quality of the product, it may be provided according to the invention for the powder collected in a reserve chamber to be fluidized using nitrogen and mixed and, while maintaining the nitrogen atmosphere, fed into a container or a capsule, respectively, with a total weight of greater than 0.5 t, compacted using mechanical strikes and enclosed in a gas-tight manner.

In this manner, it can be ensured that, using the previously cited parameters for the hot isostatic pressing cycle, homogeneity and maximum material density of the produced block are achieved when the homogenized powder is placed in an economically favorable manner in a container or a capsule, respectively, with a diameter or thickness, respectively, equal to or greater than 400 mm and a length of at least 1000 mm.

When the powder-filled capsule is placed in a HIP device in a cold state and a subsequent heating of the powder capsule occurs with pressure from all sides, on the one hand, the heat penetration time can be shortened due to an increased conduction of heat and the powder mass can be preconsolidated with respect to a substantially complete isotropy of the block.

As has been shown, it can be favorable in certain cases for the purpose of supporting consolidation for the heating and/or the pressing process of the powder to be carried out under a temperature load that is constant, optionally uniformly changing and oscillating around an average value, and for the pressing process to occur at a temperature of at least 1140° C., but no greater than 1170° C.

Due to the improved material properties, it is possible and can be particularly advantageous for the purpose of minimizing costs for the block produced according to the invention using powder metallurgy to be used in its as-HIPed state or after minimal deformation to be performed for economic reasons, as a raw material for tools or tool parts.

The further object of the invention, to create a tool steel object with improved processing and use properties with an increased service life, is attained in an object produced using powder metallurgy made of tool steel with improved material properties formed of an iron-based alloy containing in wt-%:

| | | | |
|---|---|---|---|
| Carbon (C) | 0.52 | to | 3.74 |
| Manganese (Mn) | | up to | 2.9 |
| Chromium (Cr) | | up to | 21.0 |
| Molybdenum (Mo) | | up to | 10.0 |
| Nickel (Ni) optionally | | up to | 1.0 |
| Cobalt (Co) | | up to | 20.8 |
| Vanadium (V) | | up to | 14.9 |
| Niobium (Nb) and tantalum (Ta) individually or in sum | | up to | 2.0 |
| Tungsten (W) | | up to | 20.0 |
| Sulfur (S) | | up to | 0.5 |

as well as accompanying elements up to a total concentration of 4.8 and impurities and iron as the balance, which material has a K0 value in accordance with DIN 50 602 of a maximum of 3.

Tool steels have a broad spectrum of concentration of the respective alloy elements, where these elements are always interacting with one another and must be assessed with regard to the carbon content. Lower carbon contents than 0.52 wt-% lead to a low carbide portion and/or to a low matrix hardness in the thermally hardened state of the steel while, on the other hand, higher carbon contents than 3.74 wt-%, even in a powder metallurgical production, substantially exclude the material for use as a tool due to the mechanical property profile.

The elements Mn and Cr are particularly important for a good hardenability and the mechanical and chemical properties of the objects that can be achieved, with contents greater than 2% wt-% Mn and greater than 21 wt-% Cr causing a decline in the material values necessary for the tools.

The high carbon affinity of the elements Mo, V, Nb/Ta, and W causes a desired formation of carbides and mixed carbides in an alloyed matrix in corresponding amounts. In the order given above, however, the concentration values in wt-% should not exceed 10.0; 14.9; 2.0; 20.0 because, on the one hand a desired hardening with subsequent tempering behavior and, on the other hand, the producibility and the intended mechanical properties of the materials cannot be achieved.

Optionally, Ni can be present in the alloy up to a content of 1.0 wt-% without any negative effect.

Co increases the high-temperature hardness and the edge-holding properties of the tools, but has the effect of worsening the properties above a content of 20.8 wt-%.

Sulfur contents up to 0.5 wt-% improve the machinability of the tool steel, but without negatively influencing the degree of purity of the same in such a way that the mechanical material values are reduced.

According to the invention, the tool steel has a K0 value defined according to DIN 50 602 of essentially a maximum of 3. This high degree of purity of the material causes not only a significant improvement in the mechanical properties in the hardened and tempered state, for example, a substantially increased toughness of the material, but also a substantial increase in the use properties, in particular the edge-holding property, of fine cutting tools for hard objects are significantly increased. This increase in quality of the objects produced from tool steel according to the invention using powder metallurgy is, as was found, especially due to the fact that the low amount of smaller and lack of larger non-metallic inclusions minimizes the crack initiation caused thereby.

The invention shall be explained in greater detail in the following with reference to experimental results:

For testing purposes, 50 batches at 8 t each of cold work steels and high-speed steels with a carbon content C greater than 2.2 wt-%, approximately 12.5 wt-% Cr and greater than 4.0 wt-% V and 1.1 to 1.4 wt-% C, approximately 4.3 wt-% Cr, approximately 5 wt-% Mo, 3 to 5 wt-% V, 5.8 to 6.5 wt-% W, optionally up to 9 wt-% Co, respectively, with the balance being iron and impurities were melted, placed in a metallurgical vessel attached to an atomization chamber, covered with reactive slag, which was heated by direct passage of electrical current using electrodes. In a time period of 15 to 45 minutes, a conditioning of the melt occurred using an inductive turbulent stirring of the same, with the melt level constantly being covered with hot slag. Then, a bore in a nozzle body of the metallurgical vessel was released and a melt stream having a diameter of 4 to 10 mm entering the atomization chamber was impacted by consecutive nitrogen gas streams, with the last gas stream leaving the nozzle at supersonic speed, being directed at the liquid metal, and dividing it into droplets. In the atomization chamber, a solidification of the droplets into powder grains occurred in nitrogen with a 99.999% degree of purity. The nitrogen atmosphere above the powder was also maintained during a classification and collection of the same, with samples for the classification of the powder particles being taken from the collection bin.

From the collection bin, the placing of the powder into a container or capsule, respectively, of unalloyed steel occurred, whereupon, by means of a shaking and/or tapping of the same, a packing of the powder filling and subsequently a sealing of the capsule were performed. The capsule filled with packed alloy powder and having a diameter of 420 mm and a length of 2000 mm was placed in the HIP device in the cold state, whereupon the pressure and the temperature were simultaneously increased. A hot isostatic pressing was carried out at a temperature of 1155° C. with a pressure of 105 MPa in a time span of 3.85 hours, whereafter the pressed body was slowly cooled. After a hot forming with a degree of deformation of 0.2 times to 8.1 times, samples were taken from the forged pieces.

The 50 powder samples taken from the collection bin during use of the process according to the invention were subjected to a screen analysis. The results, specifically those of the average powder proportion in the individual particle classes are provided in Table 1 (grain distribution of the metal powder) in comparison with 92 results obtained using processes according to the prior art.

TABLE 1

Grain distribution of the metal powder, proportion of particle classes in the metal powder, average particle size

| Particle class Microns | Process according to the invention proportion in % | Comparative processes according to prior art proportion in % |
|---|---|---|
| 0–45 | 31.5 | 12.7 |
| 46–63 | 20.5 | 9.0 |
| 64–75 | 8.7 | 5.3 |
| 76–100 | 11.0 | 9.2 |
| 101–125 | 7.6 | 9.8 |
| 126–180 | 9.5 | 14.0 |
| 181–250 | 6.0 | 13.2 |
| 251–355 | 3.7 | 12.8 |
| 355–500 | 1.5 | 14.0 |
| Average particle size | 61 μm | 141 μm |

Powders that were produced with a process according to the invention had a proportion of the total amount of 52% up to a grain diameter of 63 um and a proportion of approximately 72% up to a grain size of up to 100 μm. Powders produced according to the prior art, on the other hand, have proportions of 21.7% and 36.2% for the same classes. If one compares the average particle size obtained, it is 61 μm using the powder production according to the invention, whereas an average particle size of 141 μm, which is more than twice as large, was determined in a powder production according to the prior art.

Figure 1A:
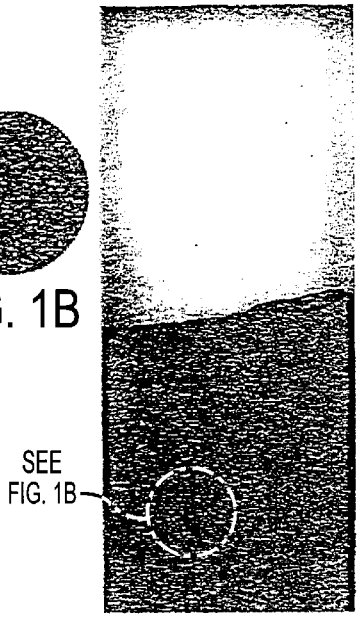
Figure 2A:
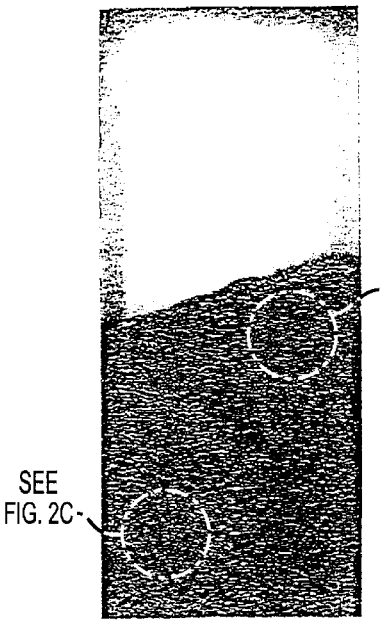
FIG. 2 shows powder in a bulk fill according to the prior art.
Figure 2B:
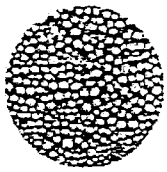
Figure 2C:
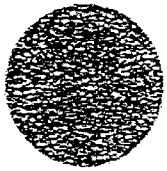
Figure 3B:
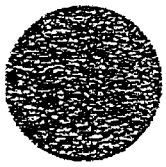
FIG. 3 shows powder in a bulk fill according to the present invention.
Figure 3A:
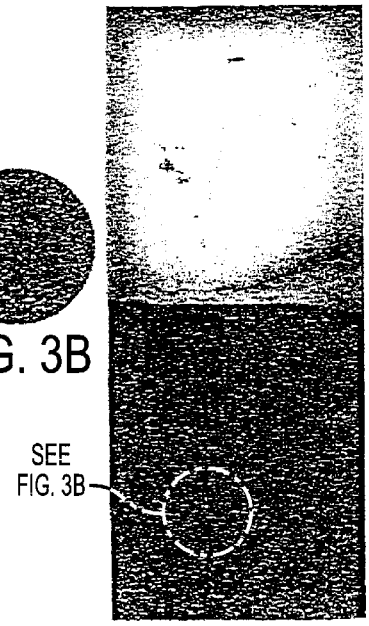
Figure 4A:
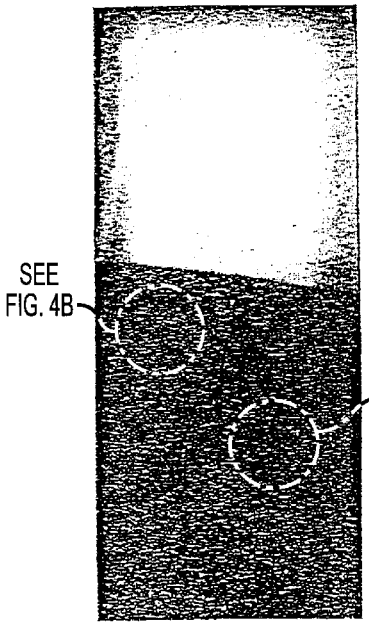
FIG. 4 shows powder in a bulk fill according to the prior art.
Figure 4B:
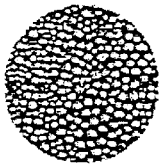
Figure 4C:
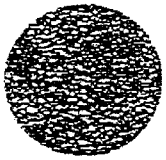

In FIG. 1 (production process according to the invention) and FIG. 2 (production process according to prior art), powder is shown in a bulk fill. In such a fill, as is shown in FIG. 2, regions of demixing occur in comparable powders (prior art) with a concentration of coarse powder grains 1 and fine fractions 2. On the other hand, in the powder produced according to the invention, there is extensive homogeneity. The same is for FIG. 3 (powder production according to the invention) and FIG. 4 (comparison powder) according to the prior art.

After a hot forming, samples were taken from the 50 blanks a different . chemical composition, produced using the process according to the invention and their degree of purity and content of non-metallic inclusions were tested according to DIN 50 602 and ASTM E 45 /85 Meth.D. These results were compared to results of 92 samples of materials of the same type but produced according to the prior art and are reproduced in Table 2 (inclusion content of PM tool steels K0) and Table 3 (inclusion content of PM tool steels according to ASTM value).

TABLE 2 inclusion content of PM tool steels K0 (DIN 50 602)

| | Tool steel according to the invention | | Tool steel according to the prior art | |
|---|---|---|---|---|
| K0 | Number of Samples | Proportion % | Number of Samples | Proportion % |
| 0 | 28 | 56.0 | 15 | 16.3 |
| 1 | 18 | 36.0 | 28 | 30.4 |
| 2 | 3 | 6.0 | 19 | 20.7 |
| 3 | 1 | 2.0 | 12 | 13.0 |
| 4 | | | 7 | 7.6 |
| 5 | | | 2 | 2.2 |
| 6 | | | 3 | 3.3 |
| 7 | | | 1 | 1.1 |
| 8 | | | | |

TABLE 2-continued inclusion content of PM tool steels K0 (DIN 50 602)

| | Tool steel according to the invention | | Tool steel according to the prior art | |
|---|---|---|---|---|
| K0 | Number of Samples | Proportion % | Number of Samples | Proportion % |
| 9 | | | | |
| 10 | | | | |
| 11 | | | | |
| 12 | | | 1 | 1.1 |
| 13 | | | 1 | 1.1 |
| 14 | | | 1 | 1.1 |
| 15 | | | 1 | 1.1 |
| 16 | | | | |
| 17 | | | | |
| 18 | | | 1 | 1.1 |
| 19 | | | | |
| 20 | | | | |
| Total | 50 | 100 | 92 | 100 |

Figure 5:
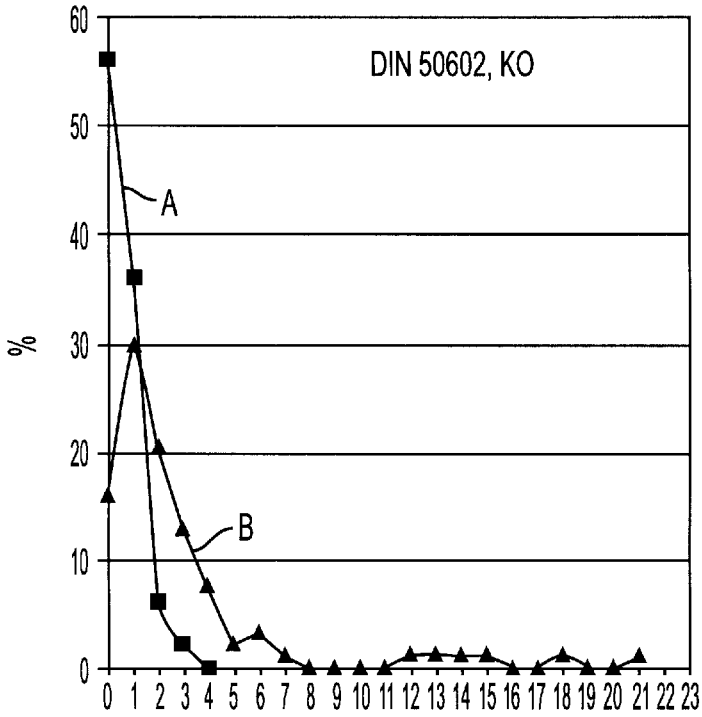
FIG. 5 shows plots of sum characteristic value vs. proportion according to DIN 50 602 K0 of material according to the present invention (A) and material of the prior art (B)

In an evaluation of the inclusion content in the material according to DIN 50 602 process K0, overall: sum characteristic values up to a maximum of 3 were determined with a portion of this value of 2% in tool steels according to the invention. In contrast, as can be seen from Table 2, tool steels produced according to the prior art showed a substantially higher content of non-metallic inclusions with a comparatively large diameter. A graphic depiction of the results of this evaluation is shown in FIG. 5, where the sum characteristic values are shown on the abscissa and their proportions in % being plotted on the ordinate. Therefore, curve A shows the material according to the invention and the curve B shows a steel produced according to the prior art.

A farther examination of the content of non-metallic inclusions in tool steels produced using powder metallurgy was carried out according to ASTM E 45/85 Meth.D.

Figure 6:
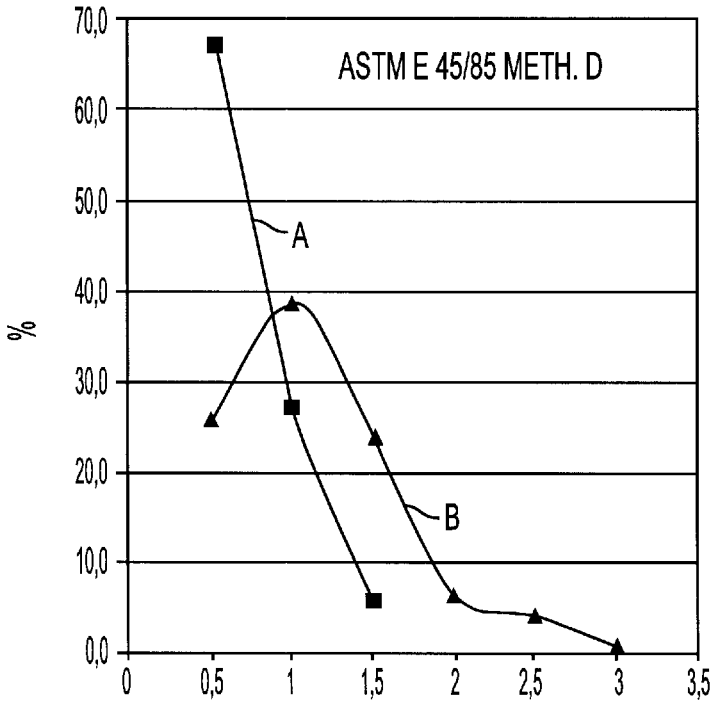
FIG. 6 shows plots of sum characteristic values vs. proportion according to ASTM E 45/85 Meth. D of material according to the present invention (A) and material of the prior art (B).

As can be seen from Table 3, a maximum ASTM value of 1.5 was determined in 50 samples of material produced according to the invention (curve A) at a content number of 3 and a proportion of 6.0%. With an ASTM value of 0.5, the proportion was 68%. The comparison material, produced according to the prior art, had a higher content and coarser inclusions (curve B), which is also shown graphically in FIG. 6, with the ASTM value again being shown on the abscissa and the percentage being shown on the ordinate.

TABLE 3

Inclusion content of PM tool steels (ASTM E 45/85 Meth. D)

| | Tool steel according to the invention | | Tool steel according to the prior art | |
|---|---|---|---|---|
| ASTM values | Number of samples | Proportion in % | Number of samples | Proportion in % |
| 0.5 | 34 | 68.0 | 24 | 26.1 |
| 1.0 | 13 | 26.0 | 35 | 38.0 |
| 1.5 | 3 | 6.0 | 22 | 23.9 |
| 2.0 | | | 6 | 6.5 |
| 2.5 | | | 4 | 4.4 |
| 3.0 | | | 1 | 1.1 |
| Total | 50 | 100 | 92 | 100 |

As was found surprisingly from the results, tool steels of the type described can be alloyed with sulfur up to a content of 0.5 wt-% without the amount of non-metallic inclusions being substantially increased or a DIN K0 value greater than 3 occurring.

What is claimed is:

1. A process for powder metallurgical production of dense products made of tool steel comprising:

providing a metal melt in a metallurgical vessel;

conditioning the melt, the conditioning comprising metallurgically working the melt and reducing oxide content in the melt, and setting the temperature thereof to a value above the formation temperature of primary precipitations;

at a temperature that is essentially kept constant, producing a powder with an average grain diameter of 50 to 70 $\mu$m from the melt by atomizing with nitrogen and disintegrating the powder in the nitrogen stream;

classifying, collecting, and mixing the powder, while maintaining a nitrogen atmosphere;

placing the powder in a container or capsule having a diameter or a thickness greater than 300 mm and a length greater than 1000 mm;

compacting the powder and sealing the container or capsule in a gas-tight manner;

forming a hot isostatic pressed (HIP) body in an HIP cycle by increasing the temperature and the pressure, followed by an isostatic pressing operation at a temperature of at least 1100° C. but no greater than 1180° C. at an isostatic pressure of at least 90 MPa for at least three hours;

cooling the body;

thereby providing a highly pure product having a K0 value according to DIN 50 602 of essentially a maximum of 3.

2. The process of claim 1, wherein the diameter of the powder grains is adjusted or classified to a maximum value of 500 $\mu$m using atomization.

3. The process of claim 1 further comprising collecting the powder in a reserve chamber, prior to placing in the container or capsule, and fluidizing and mixing using nitrogen, and while maintaining the nitrogen atmosphere, placing the powder with a total weight greater than 0.5 t in the container or a capsule.

4. The process of claim 1, wherein the container or capsule comprises a diameter or thickness of greater than or equal to 400 mm and a length of at least 1500 mm.

5. The process of claim 1, further comprising hot forming the cooled body.

6. The process of claim 1, further comprising using the product as a raw material for tools or tool parts in an as-HIPed state or at minimum deformation.

7. The process of claim 1, in which the melt is formed of an iron-based alloy comprising in wt-%:

| | | | |
|---|---|---|---|
| Carbon (C) | 0.52 | to | 3.74 |
| Manganese (Mn) | | up to | 2.9 |
| Chromium (Cr) | | up to | 21.0 |
| Molybdenum (Mo) | | up to | 10.0 |
| Nickel (Ni) | | up to | 1.0 |
| Cobalt (Co) | | up to | 20.8 |
| Vanadium (V) | | up to | 14.9 |
| Niobium (Nb) and tantalum (Ta) individually or in sum | | up to | 2.0 |

-continued

| | | |
|---|---|---|
| Tungsten (W) | up to | 20.0 |
| Sulfur (S) | up to | 0.5 |

as well as accompanying elements of up to 4.8 wt-% and impurities and iron as the balance.

8. The process of claim 1, wherein the atomizing comprises feeding conditioned melt into an atomization chamber by a nozzle body with a metal stream having a diameter of 4.0 to 10.0 mm and impacting the melt in the chamber with at least three consecutive gas streams comprising nitrogen of at least 99.999% purity, wherein the last impact of the melt stream occurs by a gas stream that has, at least in places, a speed that is greater than the speed of sound.

9. The process of claim 8, wherein the diameter of the melt stream is maintained constant.

10. The process of claim 1, wherein the HIP cycle comprises placing the container or capsule in an HIP device in a cold state and the increasing the pressure comprises increasing the pressure from all sides.

11. The process of claim 10, wherein the HIP cycle heating is carried out under a temperature load that is constant or uniformly oscillating around an average value and the isostatic pressing operation is carried out at a temperature of at least 1140° C., but no greater than 1170° C.

12. A process for powder metallurgical production of dense products made of tool steel comprising:

providing a metal melt in a metallurgical vessel;

conditioning the melt comprising use of induced turbulent flow, and setting the temperature thereof to a value above the formation temperature of primary precipitations;

at a temperature that is essentially kept constant, producing a powder from the melt by atomizing with nitrogen and disintegrating the powder in the nitrogen stream;

classifying, collecting, and mixing the powder, while maintaining a nitrogen atmosphere;

placing the powder in a container or capsule;

compacting the powder and sealing the container or capsule in a gas-tight manner;

forming a hot isostatic pressed (HIP) body in an HIP cycle by increasing the temperature and the pressure, followed by an isostatic pressing operation;

cooling the body;

thereby providing a highly pure product with a K0 value according to DIN 50 602 of essentially a maximum of 3.

13. The process of claim 12, wherein the turbulent flow is electromagnetically induced.

14. The process of claim 12, wherein the conditioning further comprises covering the melt with a slag.

15. The process of claim 14, wherein the slag is heated by electric current passing directly through the slag.

16. The process of claim 12, wherein the conditioning occurs for at least 15 minutes.

17. The process of claim 12, wherein the conditioning comprises reducing oxide content in the melt, and setting the temperature thereof to a value above the formation temperature of primary precipitations.

18. The process of claim 12, wherein the powder comprises an average grain diameter of 50 to 70 $\mu$m.

19. The process of claim 12, wherein the container or capsule has a diameter or a thickness greater than 300 mm and a length greater than 1000 mm.

20. The process of claim 12, wherein the isostatic pressing operation comprises a temperature of at least 1100° C. but no greater than 1180° C. at an isostatic pressure of at least 90 MPa for at least three hours.

21. A metal product produced by powder metallurgy from tool steel, comprising an iron-based alloy comprising in wt-%:

| | | | |
|---|---|---|---|
| Carbon (C) | 0.52 | to | 3.74 |
| Manganese (Mn) | | up to | 2.9 |
| Chromium (Cr) | | up to | 21.0 |
| Molybdenum (Mo) | | up to | 10.0 |
| Nickel (Ni) optionally | | up to | 1.0 |
| Cobalt (Co) | | up to | 20.8 |
| Vanadium (V) | | up to | 14.9 |
| Niobium (Nb) and tantalum (Ta) individually or in sum | | up to | 2.0 |
| Tungsten (W) | | up to | 20.0 |
| Sulfur (S) | | up to | 0.5 |

as well as accompanying elements of up to 4.8 t-% and impurities and iron as the balance, which product has an inclusion content K0 value according to DIN 50 602 of a maximum of 3 or, according to ASTM E 45/85 Meth.D, has an ASTM value of a maximum of 1.5.

22. The product of claim 21 comprising an inclusion content of 0 or 1 according to process K0, DIN 50 602.

23. The product of claim 21 comprising an inclusion content of 0 according to process K0, DIN 50 602.

24. The product of claim 21 comprising an inclusion content according to ASTM E 45/85 Meth. D of 0.5 or 1.

25. The product of claim 21 comprising an inclusion content according to ASTM E 45/85 Meth. D of 0.5.

26. The product of claim 21, which is produced by forming a melt, and conditioning the melt comprising metallurgically working the melt with induced turbulent flow, reducing oxide content in the melt, and setting the temperature thereof to a value above the formation temperature of primary precipitations, atomizing the melt to produce a powder, disintegrating the powder, placing the powder in a container or capsule, compacting the powder and sealing the capsule or container, and conducting a hot isostatic pressing, and cooling the body formed thereby.

* * * * *